United States Patent [19]

Motev

[11] Patent Number: 4,862,798

[45] Date of Patent: Sep. 5, 1989

[54] CYLINDRICAL OBJECT SCREEN PRINTER WITH OBJECT CENTERING MEANS

[75] Inventor: Phil Motev, Lincolnwood, Ill.

[73] Assignee: American Screen Printing Equipment Company, Chicago, Ill.

[21] Appl. No.: 94,726

[22] Filed: Jul. 2, 1987

Related U.S. Application Data

[63] Continuation-in-part of Ser. No. 794,508, Nov. 4, 1985, Pat. No. 4,712,474.

[51] Int. Cl.[4] ..... B41F 17/22

[52] U.S. Cl. ..... 101/40.1; 198/345; 101/124

[58] Field of Search ..... 101/38 R, 38 A, 39, 101/40, 35, 126, 129, 124, 40.1; 198/345

[56] References Cited

U.S. PATENT DOCUMENTS

| | | | |
|---|---|---|---|
| 2,734,619 | 2/1956 | Labombarde | 198/379 |
| 2,879,883 | 3/1959 | Wolford | 198/345 |
| 3,237,555 | 3/1966 | Jones et al. | 101/124 X |
| 3,490,363 | 1/1970 | Derrickson | 101/38 R |
| 4,176,598 | 12/1979 | Dubuit | 101/38 A |
| 4,398,627 | 8/1983 | Saccani | 101/38 A X |
| 4,507,078 | 3/1985 | Tam et al. | 198/345 X |
| 4,712,474 | 12/1987 | Motev | 101/38 A |

*Primary Examiner*—Clifford D. Crowder
*Attorney, Agent, or Firm*—Fitch, Even, Tabin & Flannery

[57] ABSTRACT

A method and apparatus for automatically screen printing on objects includes a first transfer mechanism having suction cups for swinging the objects from a supply station at which are located a plurality of the objects to a preregistering station at which is a preregistering device which rotates the objects into a predetermined orientation closely positioned to a reference position to which the object is printed. From the preregistering station, the objects are swung by a second oscillating transfer means to a third oscillatory transfer means which swings the preregistered objects to the printing station. Preferably, the objects are swung into a holding station wherein the objects are held between transfer movements by the respective second and third transfer means. At the printing station it is preferred that the objects be centered relative to the rotating chuck device by camming the objects if they are not co-axially mounted in the chuck device so as to align the spinning axis of the objects with the rotational axis of the chuck device. Grippers are swung into the printing station to remove the printed object and to convey the printed object to a discharge station.

15 Claims, 11 Drawing Sheets

10
12
13
14
15
16
17
18
20
20l
23
25
26
28l
290
32
36
37
38
40
40a
60
62
64
65
108
110
150
235
236

91
90
90a
92
93
71
20b
86
72
70
74
20
86
96
101
97
99
100
104
106

20b
275
277
240
241
242
243
253a
253
250
260
270
271
260
261
245
259
243
257
246
248
12

276
275
277
280

240
275
20b 335
20
30
31
340
341
342
346
350
352
353
347
358
349
351
355
333
333a
336
334
24

CYLINDRICAL OBJECT SCREEN PRINTER WITH OBJECT CENTERING MEANS

This application is a Continuation-In-Part application of copending application U.S. Ser. No. 794,508, filed Nov. 4, 1985 entitled "Automatic Handling and Screen Printing Apparatus", now U.S. Pat. No. 4,712,474.

This invention relates to a method and apparatus for automatically handling rotatable articles and to align a turning axis of the article with the rotational axis of a rotatable chuck.

BACKGROUND OF THE INVENTION

In screen printing apparatus, objects such as containers are often rotated about a longitudinal centerline or turning axis through the article by a rotatable drive means such as a rotatable chuck. The articles need to be positioned with their turning axis aligned with the rotational axis of the chuck. Such alignment may be more easily obtained by machines which operate very slowly in contrast to high speed machines operated e.g. at 3000 to 5000 containers per hour. At higher speeds, the containers are shifted into and from the printing station in very short periods of time and the article may not be so precisely positioned as in machines which handle the objects very slowly and maintain the articles positioned more carefully. Because the misalignment of the turning axis of the object with the rotational axis of the chuck will result in improper printing on the object irrespective of the production rate at which the machine operates the present invention is useful with slow or semi-automatic machines such as shown in U.S. Pat. No. 4,282,806 as well as the fully automatic high production machine disclosed herein. In semi-automatic screen printing apparatus, such as shown in U.S. Pat. No. 4,282,806, the article to be printed may be loaded manually in a hopper and a container is transferred by a single transfer arm directly from the hopper to the printing station. The printing head carrying the screen is raised to accommodate feeding of the object into a chuck which automatically rotates the object to a reference position for initiation of printing. A rack and pinion drive rotate the chuck and the object in timed relationed to movement of the screen relative to a stationary screen and flood bar. After printing, the object is removed manually and sent to a UV curing operation. One problem with such semi-automatic equipment is that it is relatively slow in production. A considerable portion of the cycle is spent in raising and in lowering the printing head and in turning the container to its reference position.

Silk screen printing apparatus disclosed in the aforementioned patent may be set up rather quickly to handle various diameters of containers. When changing sizes of containers, the rotational velocity of container surface is matched to the linear velocity of the screen by changing the size of the gear driven by the rack. Also, the nest or container receiving pocket on the transfer arm is changed where the difference in container diameter is quite large. Such set up time is relatively simple and easily accomplished as contrasted to existing conventional fully automated equipment used for silk screening apparatus.

More specifically, a known silk screen printing apparatus of the automated kind employs a walking beam transfer mechanism which has a number of container receiving grooves or notches therein to hold a series of containers each being moved incrementally toward the printing station. Such a system is difficult to set up for different sizes of containers or for different objects. The change of size of the walking beam and the adjustments of the movement thereof, as well as to change the rotational speeds, has resulted in many hours of set up time being required for substantial changes in container diameters. Furthermore, the articles are jostled as they are moved step by step by the walking beam and the articles may be marked or marred by such movement. There is a loss of accuracy of container position with such a walking beam. Often this walking beam printing equipment is not able to be quickly converted from cylindrical containers to other container shapes such as oval or conical.

Thus, there is a need in the industry for an automatic screen printing apparatus that may be readily set up to handle each of several sizes as well as shapes of containers. For instance, some users may change from a one ounce container to a quart container, and from a cylindrical to an oval container, and they desire that the set up time for the changeover be similar to that used for semi-automatic screen printing apparatus of U.S. Pat. No. 4,282,806.

In addition to having shortcomings in handling various sizes and shapes of containers, existing automatic screen printing apparatus is complicated and expensive. The walking beams and chain conveyors used heretofore for article feeding and handling involved considerable mass and momentum to be overcome in each printing and feeding cycle. When using a large number of moving parts, the adjustments thereof, the tolerance buildups and the multiple adjustments necessary to obtain the desired position of registration of the printed material on the container are time consuming. Furthermore, large chain conveyors or walking beam conveyors add considerable to the expense of the automatic screen printing apparatus relative to semi-automatic screen printing apparatus.

The present invention is particularly useful when handling articles such as containers or bottles at very high rates of production, e.g. 4000 containers per hour. In such equipment, the containers are fed automatically from incoming supply conveyor to the printing station at which the container's axis of turning must be aligned with the axis of rotation of the chuck. The chuck turns the container as the printing progresses about the circumferential surface of the container. When the container's axis is not aligned with the chuck axis, inferior or poor printing results. Thus, there is a need to provide container and chuck alignment means on such high production screen printing apparatus which means is highly reliable and consistent in its operation. A need also exists to remove the printed articles automatically from the chuck at these same high production rates and to discharge the articles to a conveying means, which may be a conveyor leading to and through a UV curing apparatus for a UV ink applied to the containers.

Accordingly, a general object of the invention is to provide a new and improved article and chuck axis alignment in a screen printing apparatus.

Another object of the invention is to provide an automatic screen printing apparatus with improved article handling and positioning means to position articles consistently in alignment with the rotational axis of a rotating chuck with simple and inexpensive equipment.

These and other objects and advantages of the invention will become apparent from the following description of the invention taken in connection with the accompanying drawings.

DETAILED DESCRIPTION OF THE DRAWINGS

Figure 4A:
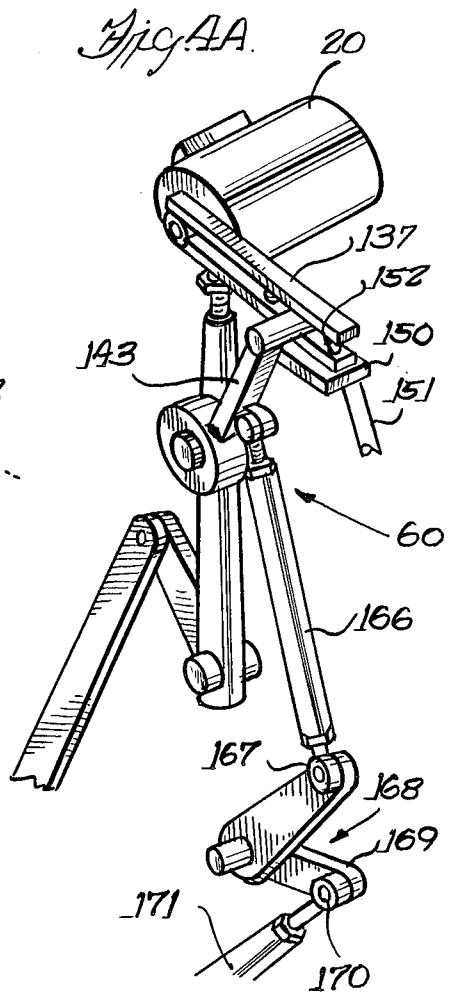
FIG. 4 is an illustration of the first transfer arm means positioned to grip a container at the supply station and at the preregistering station for removal therefrom.
Figure 5:
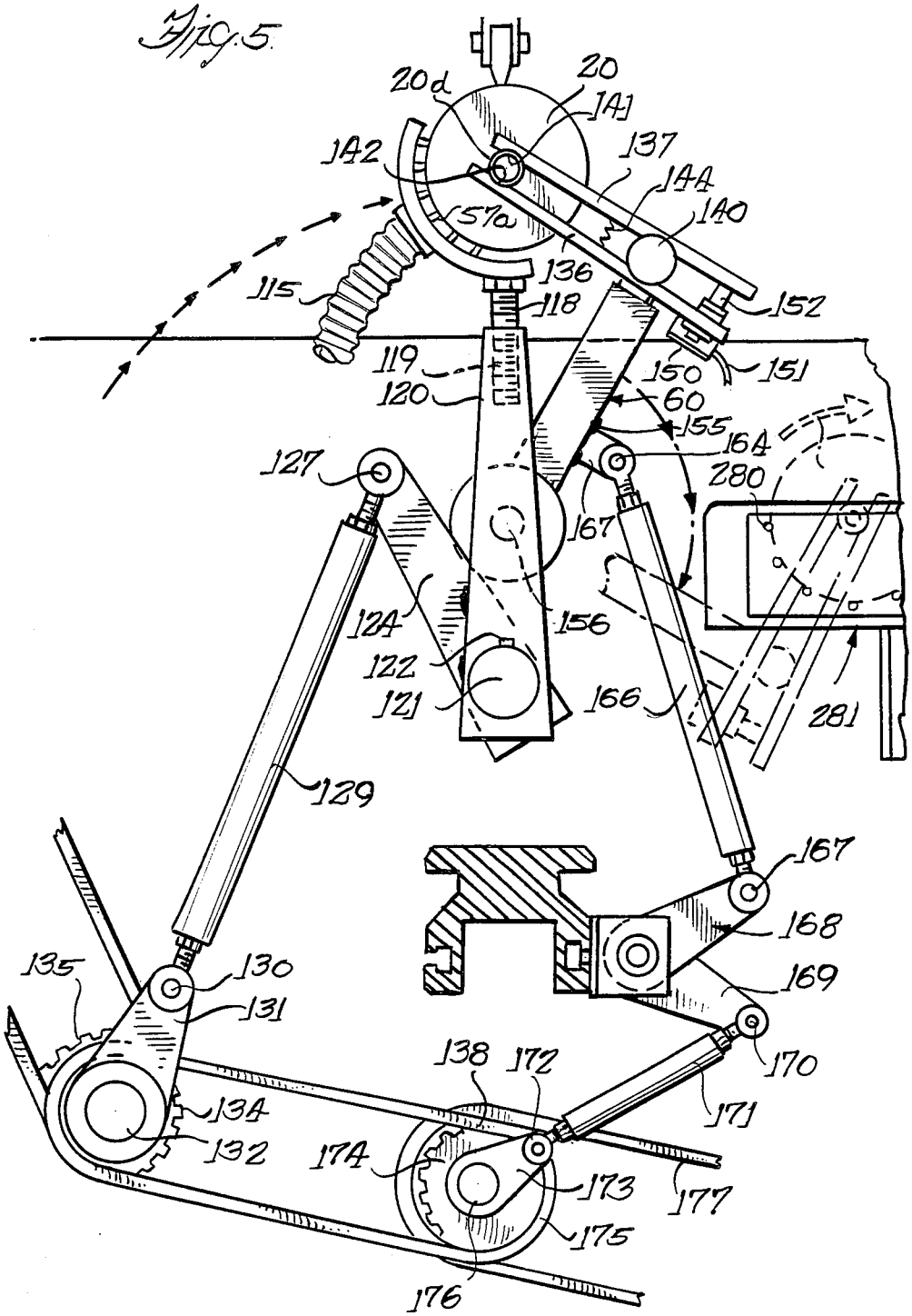
Figure 6:
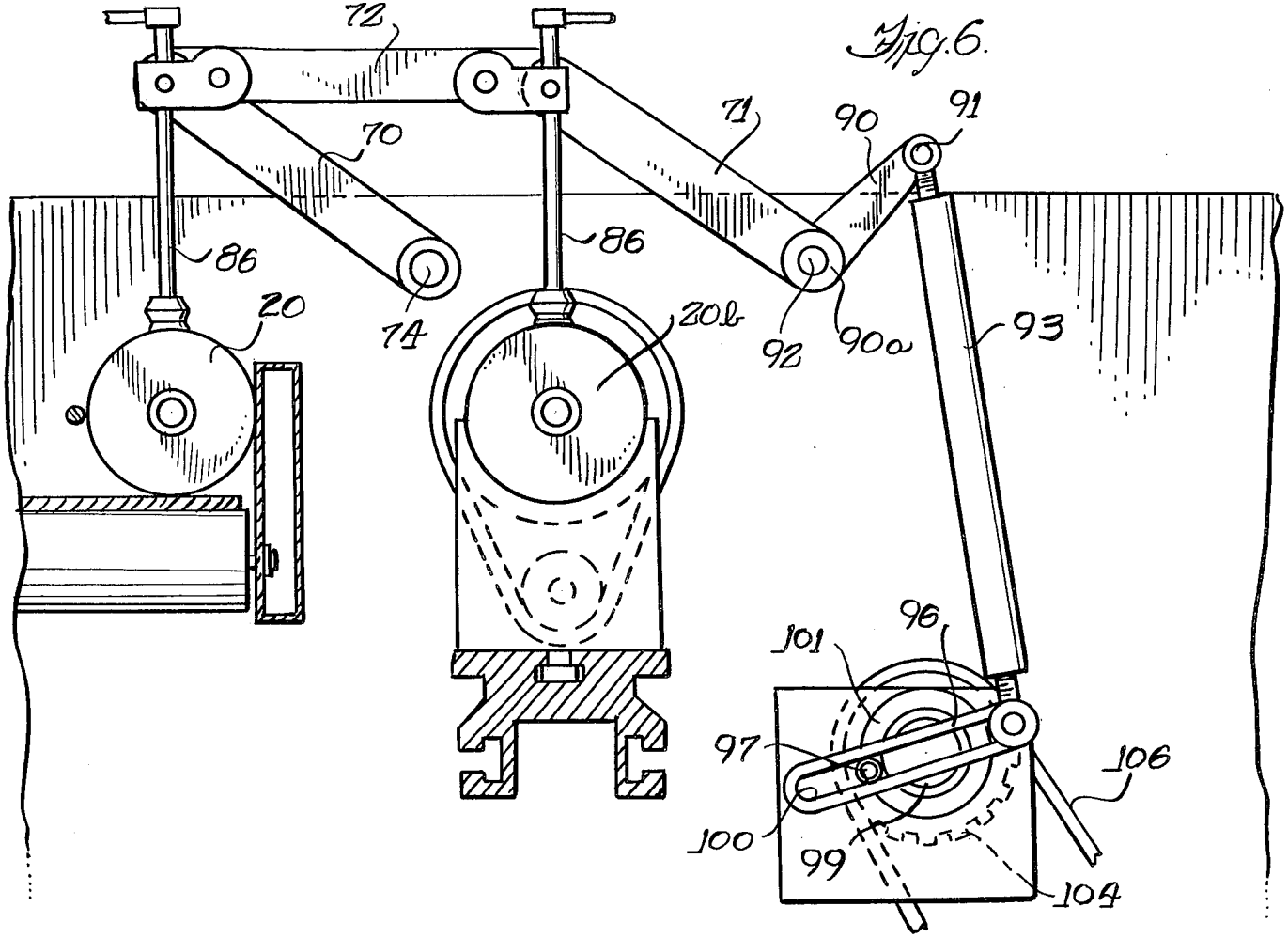
Figure 7:
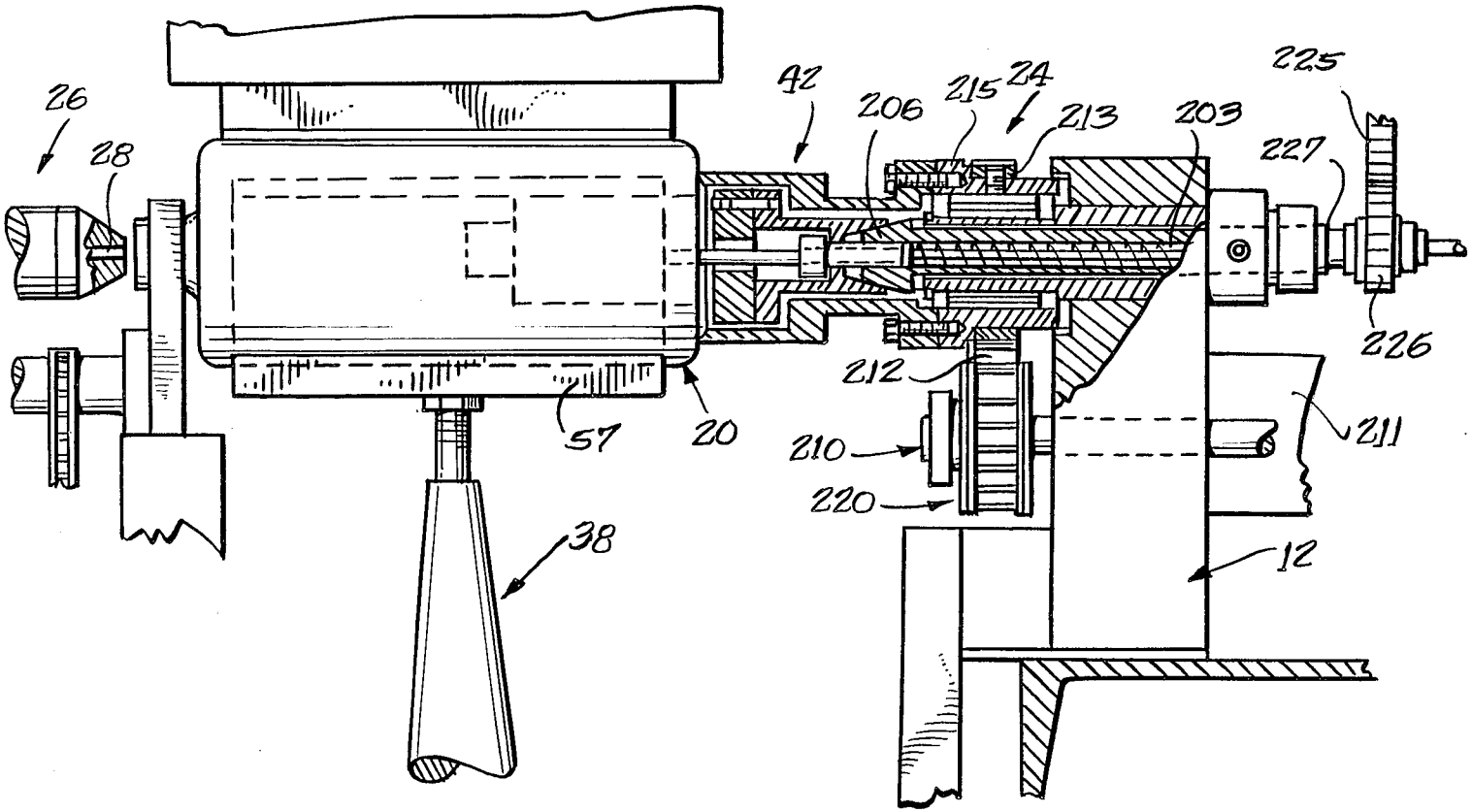
Figures 8, 9, 10:
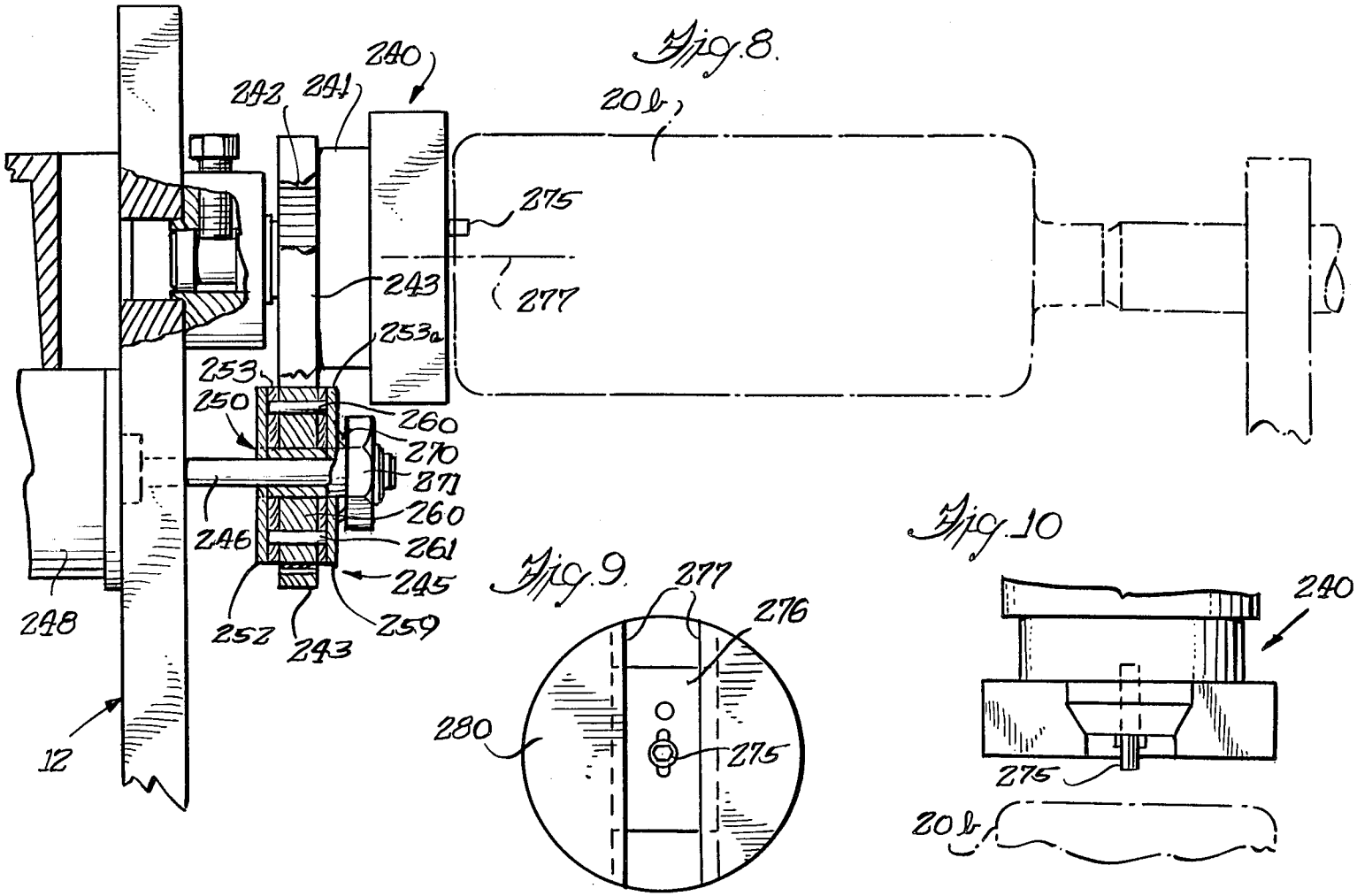

FIG. 4*a* illustrates the drive for the transfer means to remove the container from the print station;

FIG. 5 illustrates the drive for the print transfer arm and for the discharge transfer arm;

FIG. 6 is a view showing the first transfer arms when picking up containers for transferring from the supply station and the preregistration station;

FIG. 7 is a partially sectioned view of the printing station and a chuck thereat and constructed in accordance with the preferred embodiment of the invention;

FIG. 8 is a partially sectioned view of the chuck and slip clutch at the preregistration station;

FIG. 9 is an enlarged view of a preregistering pin and its mounting at the

Figures 11, 12, 13:
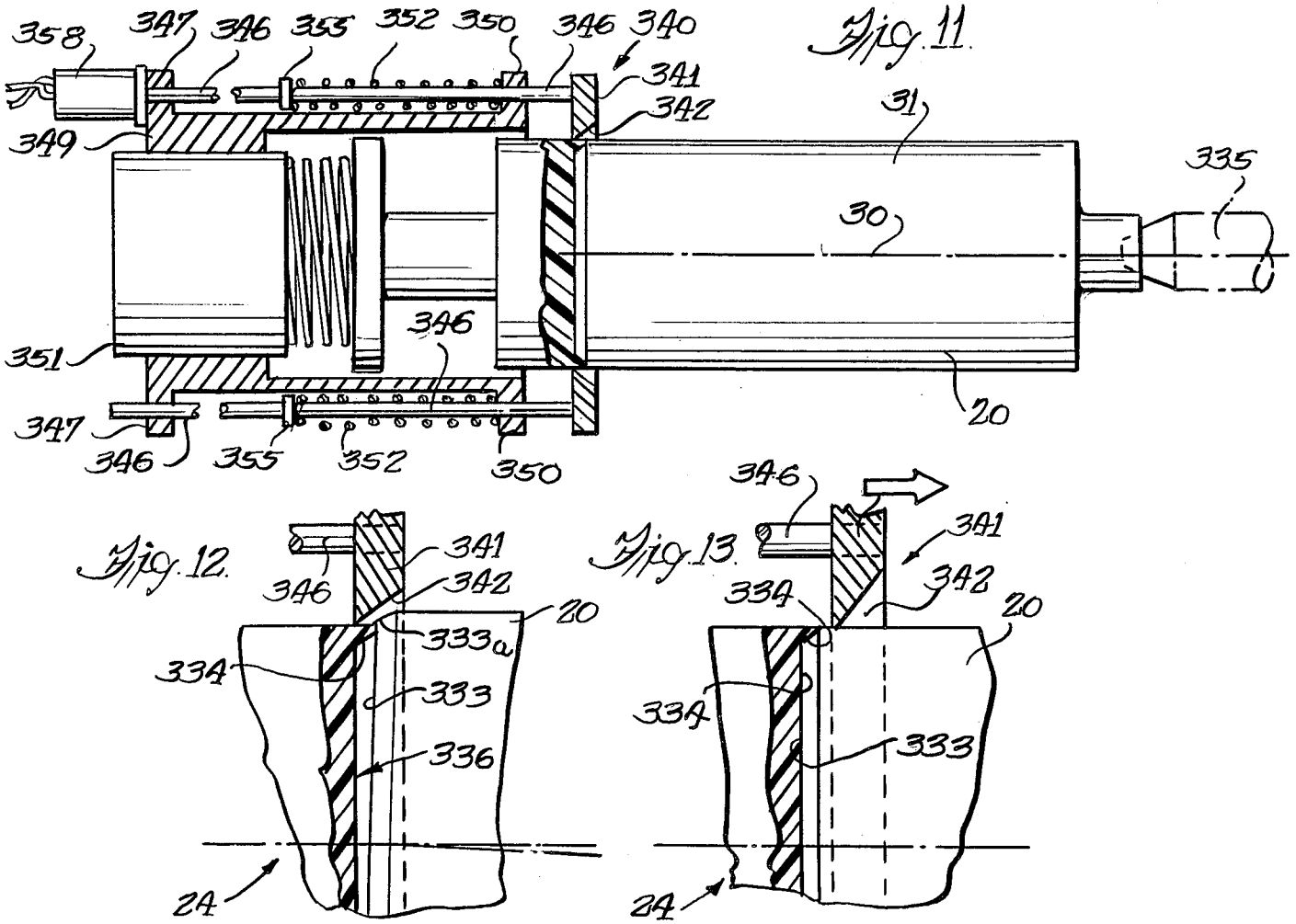
Figure 14:
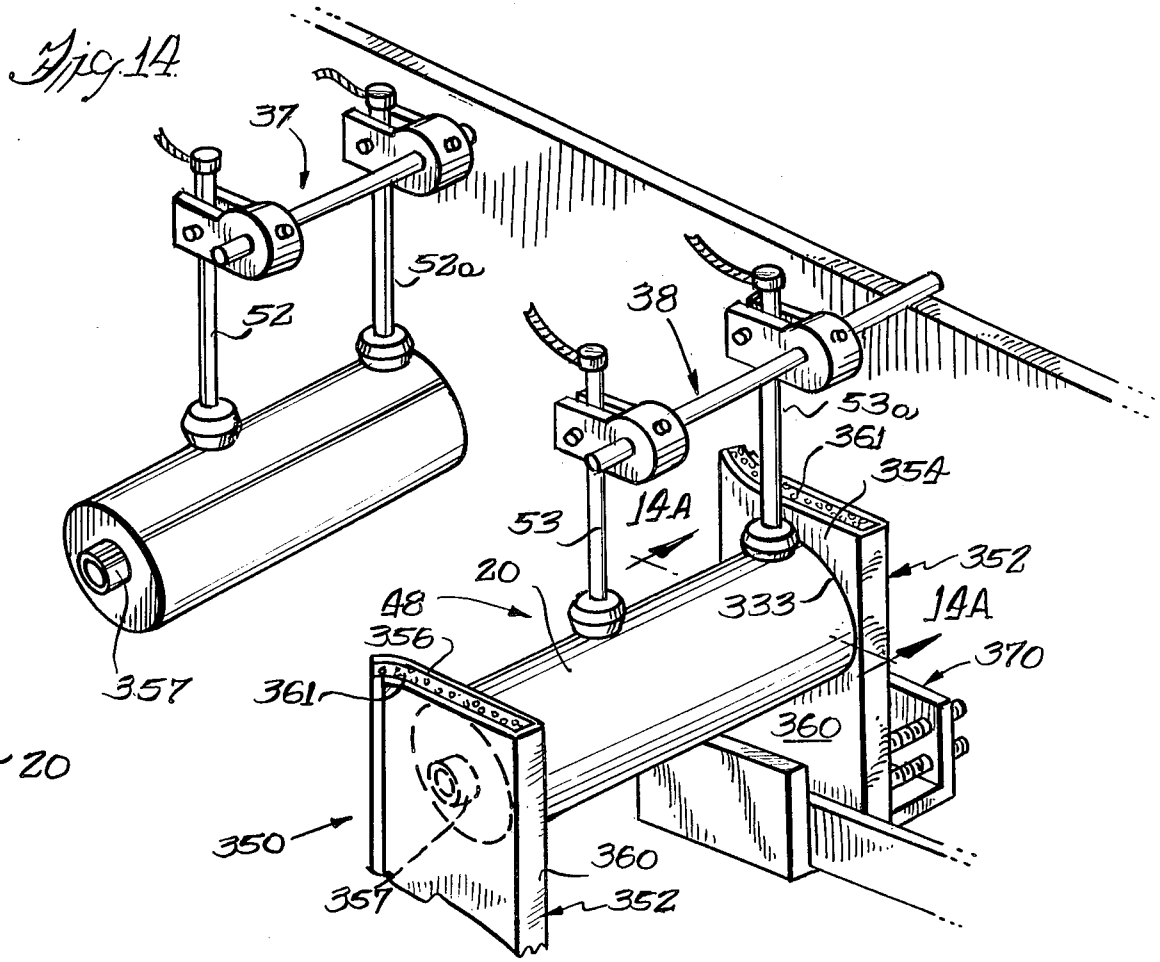
Figure 14A:
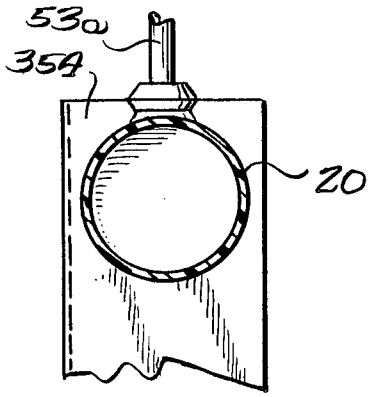

FIG. 10 is a view of the preregistering pin for engagement with the ramp on the container at the preregistration station;

FIG. 11 is a plan view of an article centering means for a rotating chuck;

FIG. 12 is an enlarged fragmentary cross sectional view showing a centering ring about to cam a container located at the chuck means;

FIG. 13 is a cross sectional view showing the centering ring camming the container and the container nested in the chuck means;

FIG. 14 is a view showing the holders for holding a container constructed in accordance with another embodiment of the invention;

FIG. 14A is a cross sectional view taken substantially along the line 14*a*—14*a* in FIG. 14.

Figure 15:
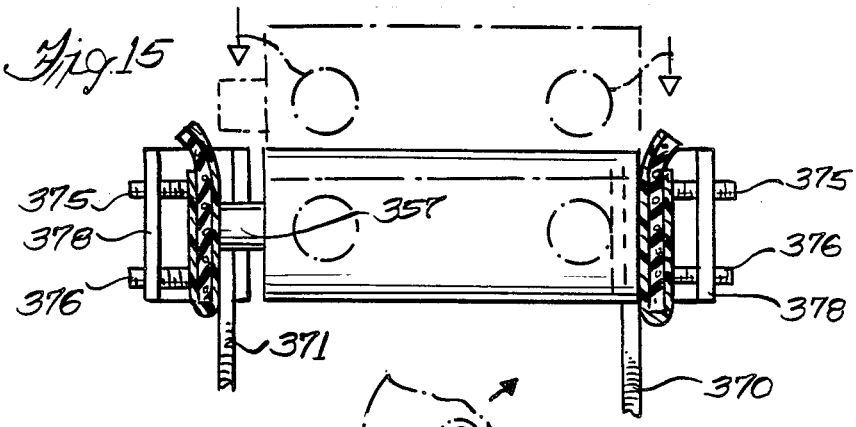
Figure 16:
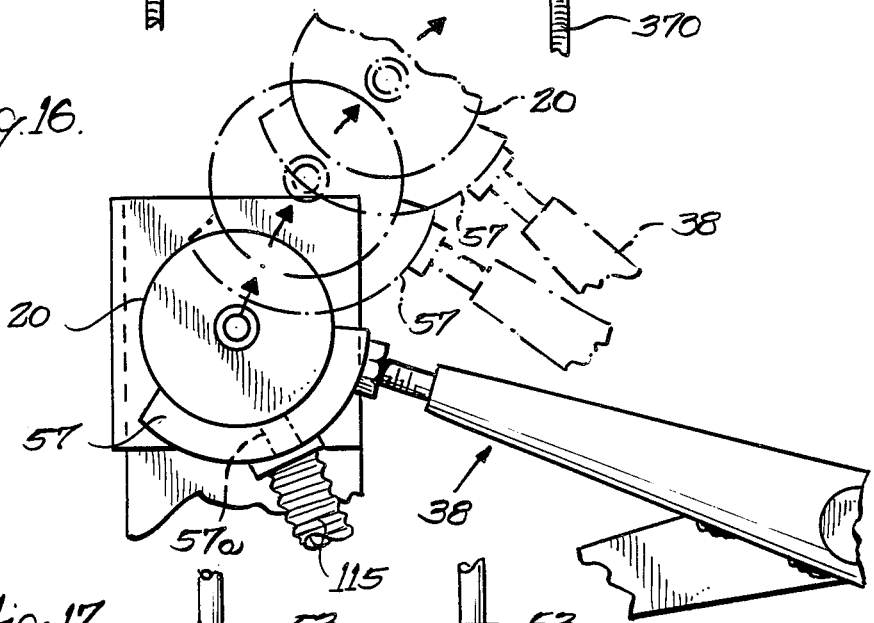
Figure 17:
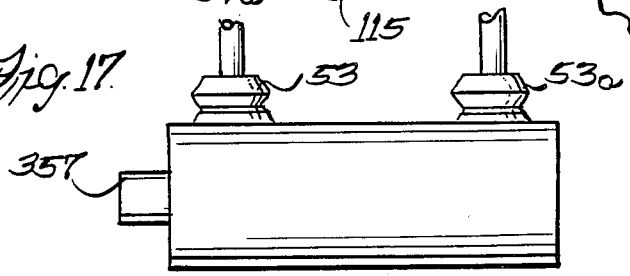
Figure 17A:
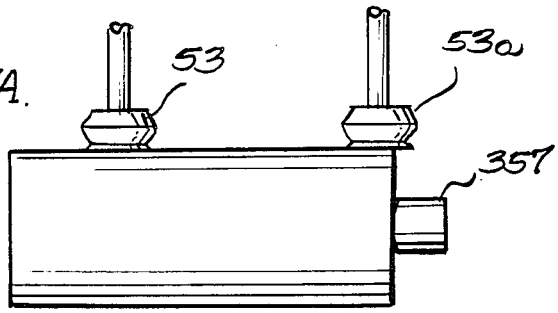
Figure 18:
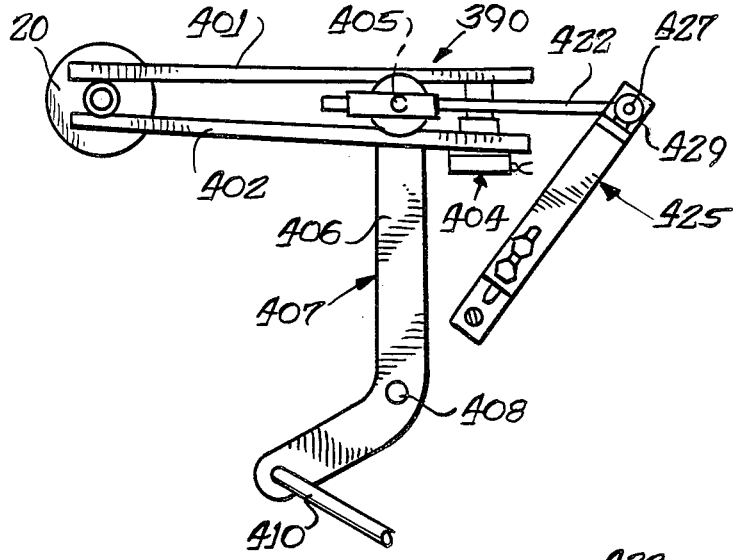
Figure 19:
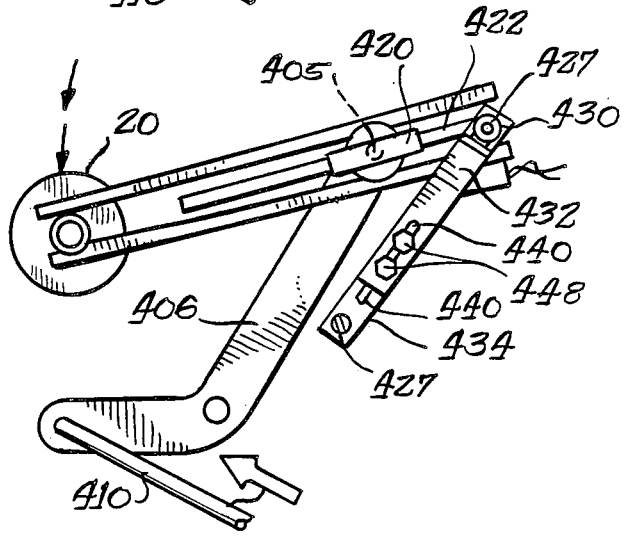
Figure 20:
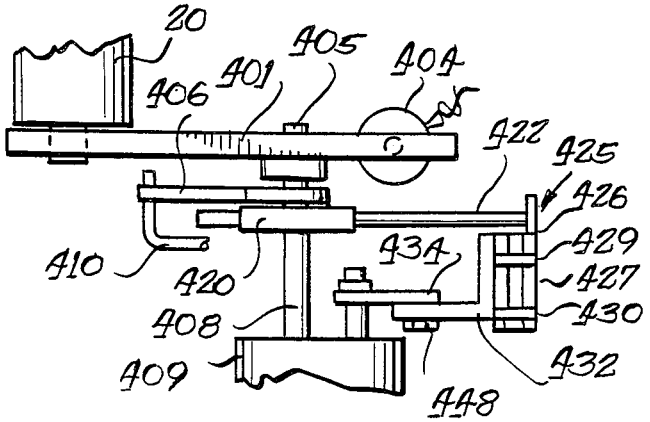

FIG. 15 is a view partially in section showing the holder holding a container;

FIG. 16 is a fragmentary elevational view showing a transfer arm with a nest for gripping a container in the holder;

FIG. 17 is a side elevational view showing a container gripped by a pair of suction cups;

FIG. 17A is a view similar to FIG. 17 with the container reversed and extending in the wrong direction;

FIG. 18 is a side elevational view showing a discharge gripper means constructed in accordance with another embodiment of the invention;

FIG. 19 is another view of the discharge and gripper means of FIG. 18; and FIG. 20 is a plan view of the discharge gripper means as shown in FIG. 18.

DETAILED DESCRIPTION OF THE PREFERRED EMBODIMENTS

As shown on the drawings for purposes of illustration, the invention is embodied in a screen printing apparatus 10 which includes a frame 10, including a pair of upstanding side frame members 12 between which extends a front frame plate 13. The frame supports a screen assembly 14 above which is mounted a squeegee assembly 16 comprising a squeegee 17 and a flood bar 18. Objects to be printed, which are usually in the form of a cylindrical or oval container 20, although other objects may be imprinted, are mounted for rotation beneath a screen is for movement relative to the screen and squeegee assembly Herein, the container 20 is rotated by a rotatable chuck 24 at the inner side of the machine and the opposite small diameter end of the container is mounted for rotation by a rotatable spindle 26 which usually has an air conduit 28 (FIG. 7) therein through which air is blown into the interior of the container to assist in holding the container wall rigid during the printing of the operation.

U.S. Pat. No. 4,282,806 which is hereby incorporated by reference as if fully reproduced herein disclosed an apparatus, as above described, but is termed a "semi-automatic" apparatus in that it does not have an automatic feed apparatus which can automatically transfer containers to the printing station 16 and beneath the printing screen and then remove the containers automatically from the printing station for conveying away to a curing apparatus for the UV sensitive ink which is cured by exposure to UV light.

While there have been automated devices for printing on silk screen objects these are usually quite elaborate and expensive mechanisms which are not readily convertible to handle different sizes and shapes of containers. Many users of screen printing apparatus have different sizes and shapes of containers which they desire to be imprinted; but the time and expense of conversion of the automatic equipment between container sizes or shapes is almost cost prohibitive. Further, the conventional handling apparatus uses transfer chain conveyors or walking beams which are large and of such weight and mass as to make the automatic equipment relatively slow in the number of containers which are processed per hour. For instance it is desired to handle containers in the range of 3000 to 6000 per hour which is one container per second or less On the other hand, the semiautomatic equipment shown in U.S. Pat. No. 4,282,806 can be readily adjusted to handle different sizes or shapes of containers with one of the principal changes being to change the gear 318 shown in that patent to a different diameter gear so as to correlate the rotational speed of the chuck with the linear travel speed of the printing screen. This equipment of U.S. Pat. No. 4,282,806 lacks the capability however, of high speed production. Thus, there is a need for a new and improved automatic screen printing apparatus which can be readily changed to accommodate different sizes of containers or shapes of containers and which has relatively few and simple parts operating at a relatively high speed, for example, 3000 to 6000 containers per hour. Also, important to any successful automatic machine is desire that the machine be relatively trouble-free in operation.

Figures 1, 2:
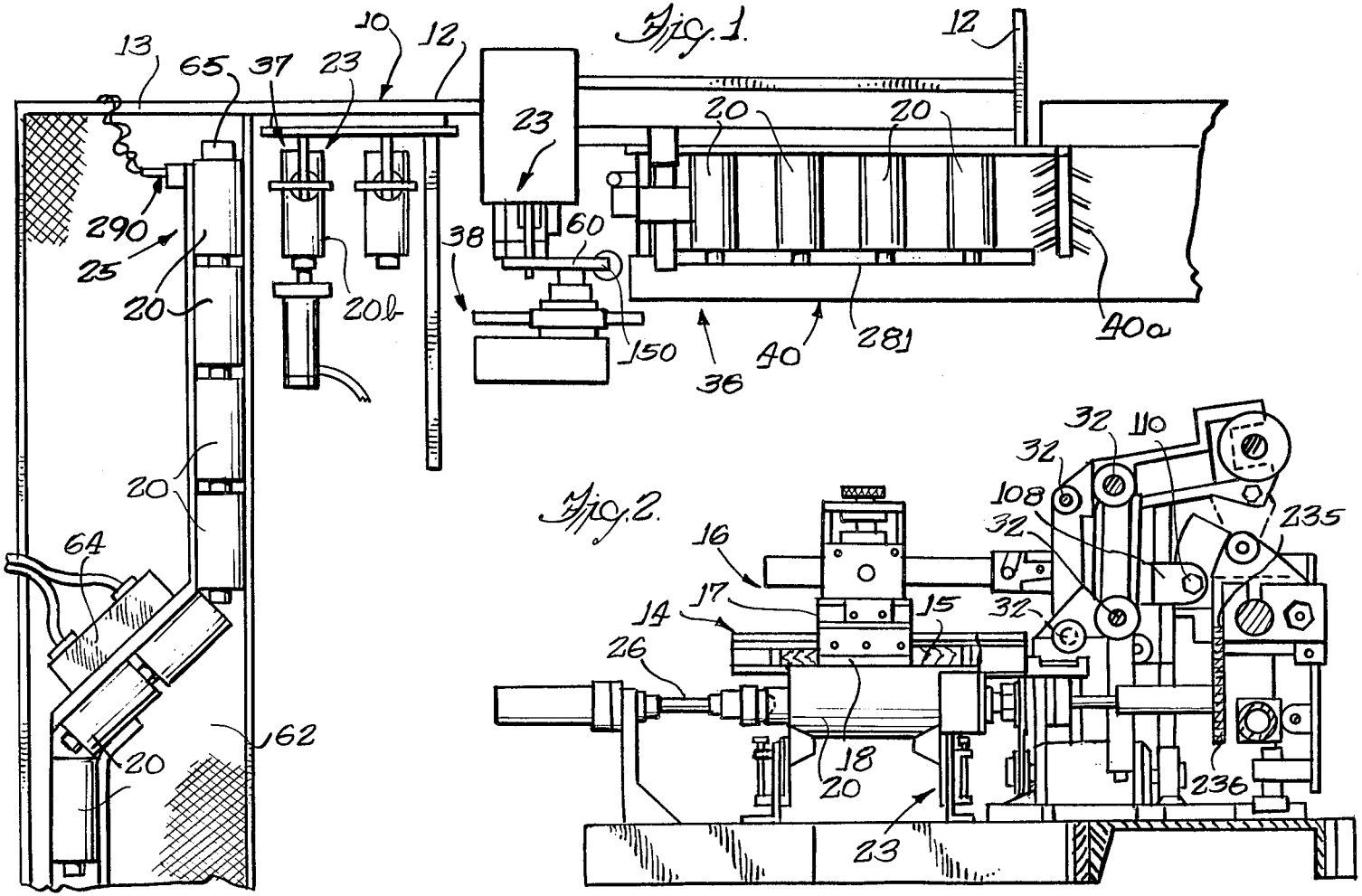
FIG. 1 is a plan view of an apparatus constructed in accordance with the preferred embodiment of the invention.
FIG. 2 is a end view partially sectioned of the screen frame and printing head assembly.

In accordance with the present invention the speed of operation of the automatic screen printing apparatus is increased by moving containers 20 through a plurality of short arcuate swinging motions and by transferring a container from and between arcuate transfer mechanisms 35 to the printing station 23 preferably while the containers 20 are held in predetermined positions. To this end, it is preferred that the containers are oriented to a predetermined orientation, i.e., a preregistering of the containers, 20 at a preregistering station 30 wherein each container is located at substantially the rotational position it is at when the printing is commenced. This initial position at the start of printing may be called a "reference position". Because the container need be turned only slightly from the preregistered position to the reference position prior to initiation of the printing operation the time needed for orientation at the printing station 23 can be reduced. The speed of operation has further been increased in the present invention from the semiautomatic operation disclosed in U.S. Pat. No. 4,242,806 in that the print head carrying the screen assembly 14 and squeegee assembly 16 need not be lifted by the parallelogram linkages 32 on which are mounted squeegee assembly 16 and the screen printing assembly 14 as disclosed in U.S. Pat. No. 4,242,846. It has been found that almost one-half of the time used for the printing cycle in the patented apparatus is used to raise and lower the printing head assembly. Herein, the printing head assembly may be raised and lowered by the parallelogram linkage 32 in order to do other auxiliary operations and, for this reason only, the parallel lifting mechanism has been retained although it may be dispensed with if no auxiliary operation is desired. The printing head is clearly shown in FIG. 2 and reference may be had to U.S. Pat. No. 4,282,806 for a description of the parts of the printing head shown in FIG. 2.

Also in accordance with the invention, the arcuate transfer means for transferring the containers from supply station 25 to the preregistering station 30 and from the preregistering station to the printing station 23 includes a first oscillatory transfer arm means 37 and a second oscillatory transfer arm means 38 which lifts and transfers containers simultaneously between the supply station 25 and the preregistering station 30 and between the printing station 23 and a discharge station 36 at which may be located a conveyorized UV curing apparatus 40 which conveys the articles past UV light sources **40*a* which cure the ink on the containers. As will be described in greater detail hereinafter, the preferred transfer arm means 37 includes a pair of tandem transfer arms 50 and 51 having suction devices or heads 52 and 53 each of which grasps simultaneously a container with each of the containers being lifted and carried through an arc of approximately 180° from the supply station 25 to the preregistering station 30 and from the latter to printing station respectively. The preregistered container from the preregistering station is transferred at a transfer position 48 (FIG. 3) to the second or print transfer arm means 38 which has a nest or head 57 at one end thereof which receives the preregistered container. The print transfer arm means 38 swings upward from the transfer position to a vertical position at the printing station 23 and in alignment with a chuck 42 and nose spindle 44**. The transfer movements are short arcuate movements which are fast and which may have the same arcuate extent of travel for each of a plurality of sizes of containers. As will be explained in greater detail hereinafter, the transfer arms are oscillated by rotatable drives the speed of which can be readily increased or decreased.

In high production rate screen printing of rotating containers 20, the longitudinal axis of the container about which the container rotates needs to be precisely aligned with the fixed rotational axis of the chuck means 24. Considering that 4000 or more containers per hour are fed into the chuck, it will be seen that some containers may not be properly aligned when delivered to the chuck means 42 by the feed means. In accordance with this invention, means shown and described in connection with FIGS. 14–17 are provided to engage a container, whose axis is skewed or canted relative to the rotational axis of the chuck means 24, and to shift the container to align its longitudinal spinning axis with the rotational axis through the chuck means.

Also, it is preferred that previously printed container 20 be transfer from the printing station 23 to the UV curing apparatus 40 by an oscillating transfer motion using an oscillating discharge means which includes a pick off oscillating arm 60. The latter deposits the printed container into the UV curing conveyor apparatus 40 for curing of the ink.

Figure 4:
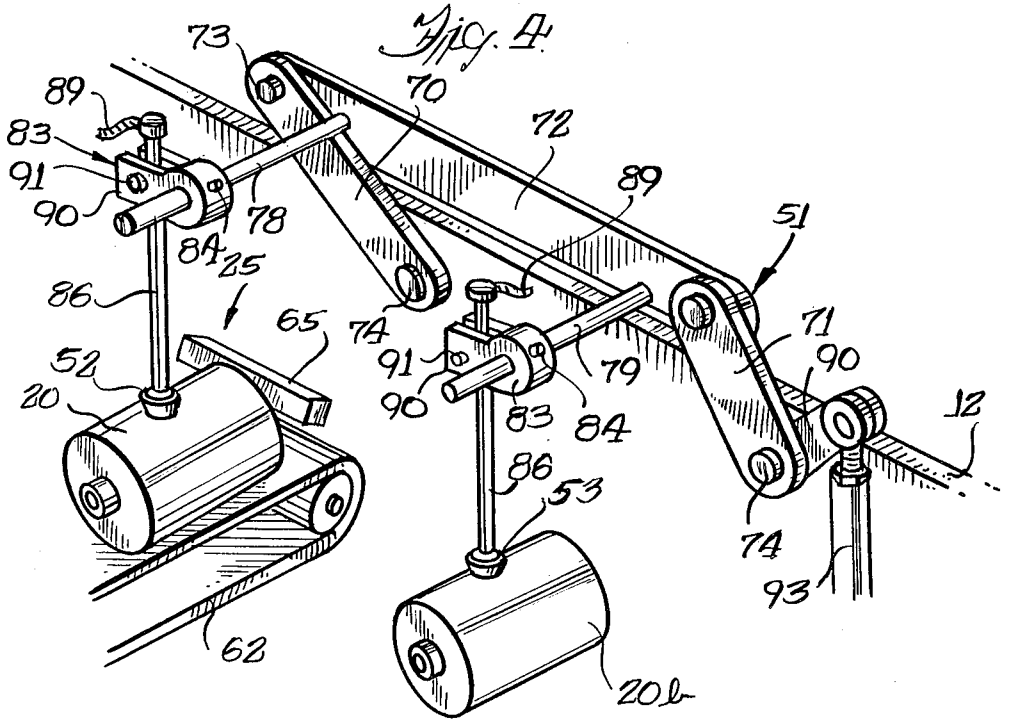

In accordance with the illustrated and preferred embodiment of the invention and as best seen in FIG. 4, the containers 20 arrive at the supply station 25 on an endless conveyor belt 62 which conveys containers continuously past a flame device 64 wherein the surfaces of the containers are treated by flame in a known manner to make them more receptive to ink. Each of the containers is fed forwardly to abut a stop 65 which holds the container at the position for being picked off by the first transfer arm means 37 with its transfer arm 50 swinging a suction head 52 thereon.

Thus, it will be seen that the preferred method of operation includes a conveying of containers 20 to a stop or supply location at the stop 65 from which the transfer arm 50 picks off the leading container from the conveyor while simultaneously the second arm 51 of the tandem first arm means 37 is shifting the second container **20*b***.

These tandem transfer arms 50 and 51 include, in this preferred embodiment of the invention, a pair of upstanding parallel levers 70 and 71 (FIG. 4) joined at their upper ends by a horizontally extending common link 72 pinned and pivoted at these upper ends by pivot pins 73. The levers 70 and 71 are pivotally mounted at their lower ends in spaced bearings 74 carried by the frame side member 12. The levers pivot together through an arc of about 180°. Mounted on the levers are horizontal support rods 78 and 79 projecting forwardly from the link 72. Inner ends of the rods 78 are fastened to the link with the rods being aligned parallel and in a common horizontal plane. Mounted on each the rods is one of the vacuum or suction heads 52 and 53 each of which has an upper slide bracket 83 with a horizontally extending bore through which projects an associated rod 78 or 79. A set screw 84 threaded in the slide bracket is tightened against the rod to hold the suction head at a given location on the rod; and for different sizes of containers the set screw is loosened and the bracket 83 is shifted along the rod and then locked in position. The suction heads include a hollow vertical shaft 86 with the respective flexible suction cups 52 and 53 mounted at the lower end of the shafts and in fluid communication therewith. A flexible suction hose 89 extends from the frame to the upper ends of the hollow shafts 86 and is in fluid communication through the shafts 86 to the suction cups 52 and 53.

The height of the suction cups 52 and 53 may be readily moved vertically for different diameters of containers. To this end, the slide brackets 83 carry a split clamp portion 87 which is tightened by a screw 88 to grip the shaft 86 and to hold it at the desired vertical position.

The oscillating movement of the tandem transfer arm means 37 s not of constant velocity as is desired to move the suction head 53 quickly after depositing a container 20*b* into the nest 57 on the print transfer arm 55 so that the container does not hit the suction head 53 as the nest 57 and the container 20*b* is being swung upwardly to the printing station 23. To these ends, as best seen in FIG. 4, the illustrated drive for the tandem transfer means includes a crank 90 having a lower end fixed to a hollow shaft portion 90*a* which rotates about a fixed bearing post 74 secured to frame plate 12. The lower end of lever 71 is fastened to the crank shaft portion 90*a* to turn when the crank 90 turns. A free end on the crank 90 connected by a pivot pin 91 to the upper end of an adjustable link 93 which is pivotally connected by a pin 94 to one end of a driven crank lever 96 which is pivoted at its opposite end by a pin 97 to the side frame member 12. The crank lever is driven by a camming roller 99 mounted in a slot 100 in the crank lever. The camming roller 99 is rotatably mounted on a rotatable drive disk 101 to turn around an axis 103 for the disk and of the shaft 102 carrying the disk. The shaft 102 is mounted for rotation in the side mounted in the frame 12 and is rotated by a sprocket 104 fixed to the shaft. A drive chain 106 is entrained about the sprocket. When the sprocket 104 is rotated from the position shown in FIG. 3, the camming roller 99 moves through about 300° and moves the suction head 53 faster away from the nest 57 and then for the 60° arc of the drive roller 99 to bring the transfer arms 50 and 51 back to the pick up position shown in FIG. 4, the suction heads are slowing down in movement as they approach the position to engage the next containers 20 and 20*b*.

The container 20*b* is deposited in the nest of the suction head 57 of the print transfer arm 51 when it is in the position shown in FIG. 4, which is its lowest horizontal position; and the print transfer arm means 38 swings upwardly to a substantially vertical position to deliver the container to the printing station 23 as best seen in FIG. 5. The container is held in the nest 57 which is an arcuate plastic member opening upwardly and which has suction ports therein which are connected to a vacuum hose 115. That is, the head 57 has suction ports 57*a* therein to provide reduced pressure to the underside of the container so that it will be held and maintain its preregistered position as it is swung upwardly by the head to the print station. The lower end of the hose is connected to a suitable vacuum pump. The illustrated print transfer arm has its suction head 57 connected at one end to a threaded shaft 118 which is threaded into a threaded bore 119 in the upper end of a tapered member 120 which is fastened at its lower end to a shaft 121 and keyed thereto at 122 to turn with the shaft 121. By turning the adjustment screw 118, the transfer head may be raised or lowered to the desired adjusted position depending upon the diameter of the container.

The drive for the print transfer arm means 55 includes a driven crank 124 which is secured at a lower end to the shaft 121 and is keyed thereto to turn the shaft and the transfer arm. The upper end of the driven crank 124 is pivotally connected by a pin 127 to the upper end of an adjustable link 129 which is connected by a pin connection 130 at its lower end to a rotatable crank arm 131 which is secured to and driven by a shaft 132 mounted in the frame for turning movement. The shaft 132 has mounted thereon a pair of sprockets 134 and 135. The sprocket 135 drives the chain 106 for the tandem transfer arm means 37. The other sprocket 134 fixed to the shaft 132 is driven by an input drive chain 138 which turns both the transfer arm 55 and the tandem transfer means at the same time and in the same direction as the shaft 132 is continuously rotated by the input drive chain 138. Thus, it will be seen that the chain 138 drives the sprocket 134 to rotate the crank 131 which drives the link upwardly and downwardly to pivot the crank 124 to turn the shaft 121 which oscillates the transfer arm 55 and the suction head 57.

The takeoff or discharge transfer means 60, as best seen in FIG. 5, preferably includes an oscillating lever 155 and a pair of gripper fingers 136 and 137 which are pivotally mounted about central shaft 140 to pivot between the open position releasing the container and the illustrated closed container gripping position shown in FIG. 5, in which the gripping fingers has its arcuate curved ends 141 and 142 in gripping engagement with the small diameter neck end 20*d* of the container. The neck is not covered with ink so that the container may be removed without smearing any ink thereon. The preferred grippers includes a contractual spring 144 pinned at opposite ends to the respective gripping fingers and pulling the gripping fingers toward each other to pivot about the central shaft 140. To shift the fingers to the open space position and thereby stretch the contractile spring 144, there is provided at the other free ends of the gripping fingers 136 and 137, a solenoid 150 which preferably is an air-operated solenoid operated by an air line 150 to pull inwardly its plunger 152 to pivot the outer free ends of the gripper fingers together. On release of the air pressure, the spring 144 will pull the gripper fingers together into tight gripped relationship with the neck of the container. The shaft 140 of the grippers is mounted on the upper end of a pivotally moveable lever 155 which in turn is pivoted on a shaft means 156.

To swing the discharge transfer arm means 60 through its oscillating transfer stroke, there is a linkage drive means as best seen in FIG. 5 which includes a link 165 connected at a pin 164 at its upper end to a bracket 167 fastened to the gripper arm lever 155. At its lower end, the link 165 is connected by a pin 167 to a bell crank 168. The bell crank has a further crank arm 169 which is connected by a pin 170 to a short link 171 extending to a pinned connection 172 to a crank arm 173 which is keyed to a rotatable drive shaft 176. The rotatable drive shaft has a double sprocket arrangement with one of the sprockets 174 driving the chain 138 and with the other sprocket 175 being driven by a drive chain 177. The sprocket 175 is secured to the shaft 176 to turn the crank 173 and then operate through the above-described linkage to pivot and oscillate the pick transfer off arm 60. Thus, it will be seen that the pick-off arm moves through a short arcuate stroke in timed relationship to the oscillatory strokes of the supply transfer arms 50 and 51 and the print transfer arm 55 all driven by a common chain drive.

In order to remove the side end of the container disposed within the chuck 42 at the printing station 23, the takeoff gripper fingers 136 and 137 may be shifted outwardly in the axial direction of the container prior to the containers being swung through an arc to the curing apparatus 40. To this end, the grippers are moveable with the movable nose cone which is moved inwardly and outwardly relative to its stand 181. The nose cone is slidably mounted in a bracket 183 for rectilinear movement by an air cylinder 185 which has an air hose 186 connected thereto. The entire carriage is mounted, for reciprocation toward and from the chucks 24 and includes slides on the carriage slidable along guide rods 189 mounted on the stand 181. A. air cylinder 190 is connected to the carriage to push and pull the carriage along the guide rods 189.

Turning now to FIG. 7, there is shown the chuck means 24 for gripping the container and for rotating the container during the print operation relative to the overhead screen through which ink is being pushed by a squeegee assembly 16. When the container is inserted into engagement with the chuck, ring 200, a sensing pin 201 is pushed against a spring 202 with its interior end 203 signalling that the container is ready and present. When the container is in engagement with the chuck a rotatable register pin 205 carried on an insert 206 rotatably mounted within the chuck engages the ramp on the container. The pin 205 moves through a short arc, for example, about 5° to abut the ramp and the container is held stationary by the chuck which is being driven in the opposite direction by a slip clutch drive means 210. More specifically, the slip clutch drive means 210 includes a small drive motor 211 which drives a timing belt 212 for driving a pulley 213 which is secured to the outer periphery of a rotatable housing casing 215 to turn the same. The drive motor 211 includes a slip clutch 220 which will be described in greater detail in connection with a similar clutch used as the preregistering slip clutch 245 described hereinafter.

The container 20 is rotated through the printing stoke at a rotational velocity equal to the linear velocity of the screen 15 by a conventional drive including a rack 225 (FIG. 7) which is movable with the screen and turns a gear 226 which is attached to a central shaft 227 which extends through the side frame member 12 to the insert 206 to drive the pin 205 which rotates the container because the pin is in engagement with the ramp on the container. The turning movement moves through the printing cycle which may be a complete revolution or a part of a revolution as for printing on an oval container This printing motion is generally as disclosed in U.S. Pat. No. 4,282,806 and is conventional and hence need not be described in detail herein. Likewise, the mounting of screen and squeegee assembly on the frame is generally the same as described in U.S. Pat. No. 4,282,806 and need not be repeated herein.

Turning now to the illustrated preregistration means, shown in FIG. 8, it includes a chuck 240 which has an outer rotatable housing 241 which has a tooth portion 242 serving as a pulley in an engagement with a tooth driving belt 243 which extends to the slip clutch 245 driven by a shaft 246 of a motor 247 mounted on the frame plate 12. The slip clutch 245, as best seen in FIG. 8, has a flanged body 250 mounted on and pinned to the motor drive shaft 251 to turn with the same. The flanged body has an inner circular metal disk 252 with a circular face in frictional engagement with a circular face of facing circular friction disk 253. The friction disk 253 is pinned at 258 to the drive pulley 260 and likewise a second circular friction disk 253*a* is pinned to the opposite sidewall of the drive pulley. Mounted on the shaft 250 is another circular metal disk 259 which has inner face engaging the friction disk 253*a*. A concave spring washer 270 is engaged by a threaded nut 271 threaded on a threaded end of the shaft 246. The nut is threaded on the shaft to compress the spring washer 270 which urges and biases the friction disks 253 and 253*a* with a predetermined amount of force into engagement with the metal disks 252 and 259 to form the slip clutch. The force at which the clutch slips may be adjusted by turning the nut 271 and thereby either compressing or releasing the compression of the concave washer 270.

In order to handle different diameters of containers 20*b* and to have a preregister pin 265 aligned with a ramp on the bottom wall of the container, the preferred preregister pin 275 is mounted on a movable slide. 276 (FIG. 9) so as to be moved relative to the turning axis or center line 277 of the preregistering chuck 240 so that the pin may be moved radially inwardly or outwardly to accommodate the different diameters of containers. The slide 276 is mounted in a dovetail slot 277 in a stationary circular post 280 within the chuck housing 241 for sliding movement in a radial direction relative to the turning axis 277; and a set screw 278 secures the slide in adjusted position on the post. Thus, the chuck housing 241 is driven by the belt 243 to turn the container 20*b* to bring its ramp against the stationary pin 275 which then holds the container 20*b* while the chuck housing remains stationary and the timing belt 243 causes the slip clutch 245 to slip. Thus, the container is ready to be picked up with its ramp already at the preregistered position which is closely adjacent the final reference position it will assume when positioned by the register pin 205 at the printing station 23.

After printing, the printing discharge arm 60 will lift the container 20 and drop it into a movable wire basket or carrier 280 (FIG. 5) of a known type of UV curing apparatus 40. The illustrated airing apparatus is a conventional apparatus including a chain conveyor 281 having a plurality of wire baskets 280 on the chains with each basket arriving beneath the discharging pick off transfer fingers 136 and 137 which open and drop the container into a basket therebeneath. Preferably, a chain drive (not shown) extends from the screen printing apparatus to the conveyor drive of the UV curing apparatus so that the baskets are timed to be beneath the fingers as they open and discharge the printed container.

Figure 3:
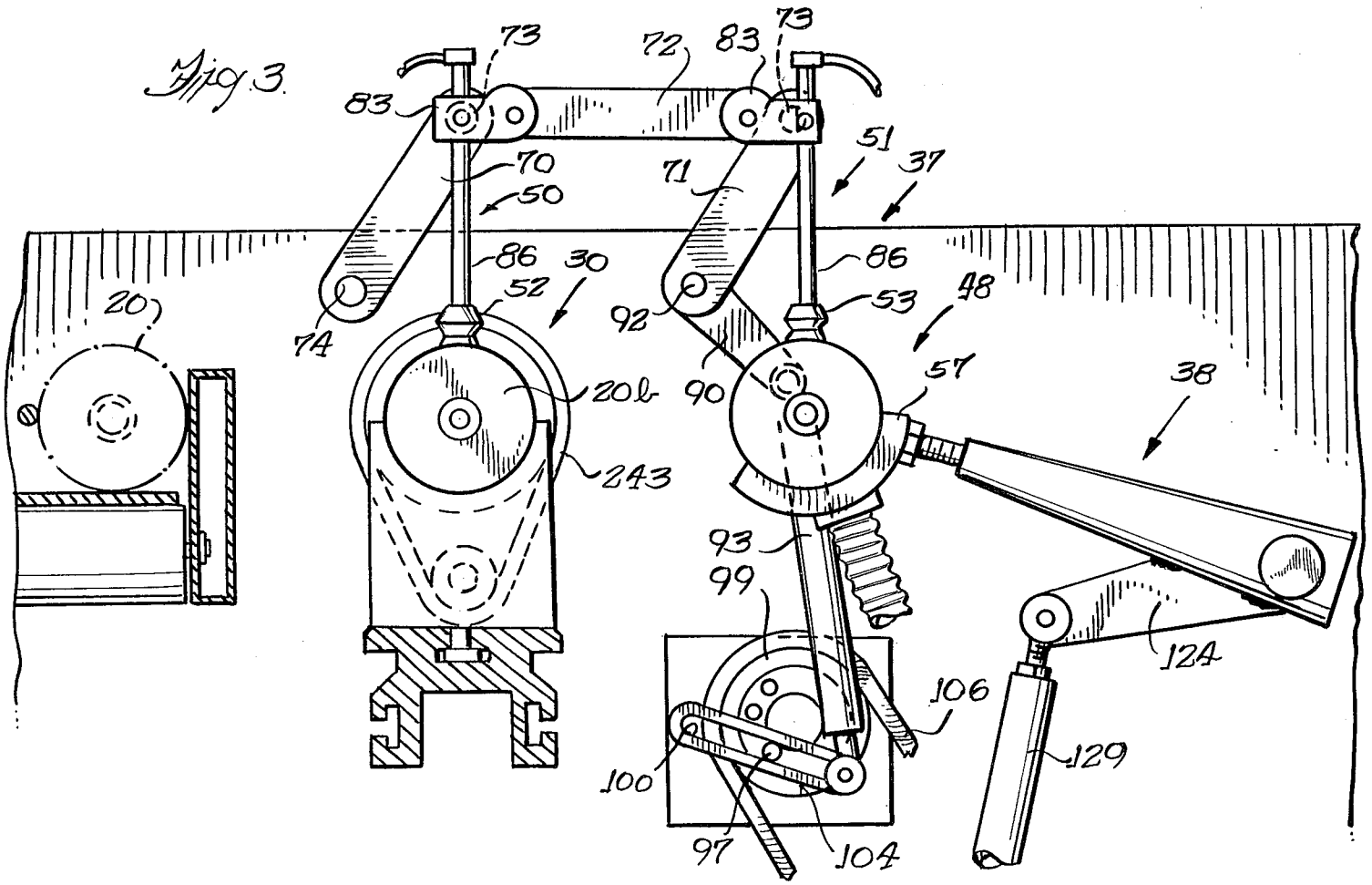
FIG. 3 is a view of the transfer means for transferring a pair of containers to the preregistering means and the transfer position.

As an aid to understanding the invention, a brief review of the operation of the illustrated screen printing apparatus will now be given. The containers are continuously moved by an inlet or supply belt conveyer 62 through a flame station and flame means 64 at which a flame pretreats the container. Each container is stopped in its forward travel by the conveyor belt when it engages the stop 65 at which is located a photoelectric sensor 290 which determines that the container is properly oriented with its neck 20*d* extending upstream and that the container is present before allowing handling operations to continue. That is, the photosensor is activated if it sees a neck 20*d* at the stop 65 or fails to see a container at the stop. The tandem transfer arm means 37 will then swing the first suction head 52 to grip the container at the stop while its parallel suction head 53 grips the container 20*b* (FIG. 4) which has been preregistered at the preregistration station 30. A short arcuate switching movement to the right and in the clockwise direction as shown in these drawings for about 180° transfers the container from the stop into the preregistration chuck means 240 (FIG. 8) and simultaneously delivers the preregistered container 20*b* into the nest 57 of the print transfer arm means 38, as shown in FIG. 3. Because of a unique drive of the tandem transfer arm and its suction head 53, the latter is quickly raised away from the nest 57 so as to not interfere with the upward travel of the print transfer arm 55 which is moving the nest 57 at a lower speed at this time. The transfer head nest 57 holds the container by suction against falling and against turning and shifts it up to the print station 23 at which the nose cone 26 (FIG. 7) reciprocates inwardly to engage the mouth of the container and to blow air into the hollow interior of the container from the air line connected to the rotatable spindle 26. The pin 205 moves to engage the ramp through a short distance usually about 5° and the container is thus in the reference position with the chuck 42 holding the container against further turning movement. Then the printing operation begins with the screen 15 and rack 225 moving to turning the gear 226 and the shaft 227 to rotate the chuck 42 and the bottle in timed relationship so that there is no relative slipping movement between the container surface and the screen surface as would cause smearing of the ink which is being forced through the screen by the squeegee assembly 16.

Simultaneously with the printing operation there is also the preregistering operation going on with the chuck 240 (FIG. 8) operating through its slip clutch 245 to turn the chuck to bring the ramp on the container against the stationary pin 275 which then holds the container 20*b* as the clutch slips with the container now in the preregistered position.

At the finishing of the printing operation, the pick off transfer arm 60 (FIG. 5) carrying the gripping fingers 136 and 137 is swung in counter clockwise direction from a location away from the neck of the container towards the container neck to bring the gripping surfaces on the ends of the fingers 136 and 137 into gripping relationship with the neck of the container. The gripping occurs when the solenoid 150 is released allowing the contractual spring 144 to pivot the fingers to a closed clamping position about the container neck. The carriage which retracts the nose cone 26 from the bottle likewise carries the gripper fingers 136 and 137 outwardly to pull the wide end of the bottle from the registering pin so that the bottle grippers may now be swung to drop the container into the baskets 280 on the conveyor 281 of the curing apparatus 40. That is the solenoid for the grippers is charged with air to swing the gripper fingers open thereby releasing the container neck to discharge the container into the basket. The ink is then cured and the container is conveyed through the curing apparatus 40.

In accordance with the invention, it is preferred to provide the apparatus above described in connection with FIGS. 1–10 with a centering means 300 (FIG. 11) which centers the turning axis 330 of containers 20 automatically with the fixed rotational axis 332 of the chuck means 24. Herein, the centering means 300 (FIGS. 11–13) serves to position the axis 330 of the container 20 on the axis or center line 332 of the chuck means 24 which has a beveled edge 334 to receive the bottom end 333 of the container. The enlarged bottom of the container is pushed by a nose cone device 335 into a circular recess 336 in the driving face of the chuck means, the recess being defined by the beveled edge 334. If the delivery of the container is not co-axially perfect, such that the axis 330 of the container is not coaxial with the axis 332 of the chuck means, the container is automatically centered by the centering means 300 which includes a camming means 340 for engaging the bottom end 333 of the container and forcing this end of the container to shift until the container axis 330 is aligned with the rotational axis 332 of the chuck means. More specifically, as shown in FIG. 12, the container axis 330 may be located above and at an angle to the chuck rotational axis 332; and, if this condition is allowed to continue during printing, the container surface will be presented with one circumferential portion too high and the diametrically opposite portion too low. This can interfere with proper printing. As seen in FIG. 12, the centering means 300 will cam upper edge 333*a* of the container bottom wall 333 down to the aligned position shown in FIG. 13.

Herein, the centering means 300 includes a reciprocal centering ring 341 having a stroke that is timed such that as the nose cone 335 comes in and pushes the container into the chuck means 24, the centering ring is also shifting to engage the container end. Preferably, ring 341 is open at the top so as not to be a complete ring in order to allow the squeegee action and to allow the screen to come down to engage the container adjacent the container end which is in the chuck means. The centering ring 341 is mounted on the ends of two parallel guide rods 346 which are mounted in spaced linear bearings 347 and 348 mounted on stationary brackets 349 and 350 fixed to the main stationary chuck housing 351. Return springs 352 are coiled about the respective slide rods 346 and have one end abutting a stop 355 fixed on the guide rod 346.

The return springs 352 are compressed between the stops 355 and the fixed brackets 350 on the stationary chuck housing. The parallel rods 346 are driven forwardly by an actuator means such as a solenoid 358 mounted on this rear bracket 349 and having its solenoid plunger connected to at least one rod 346 to reciprocate the rods and the centering ring carried thereby. When the solenoid 58 is released, the springs act on the stops 355 to retract the rods and the centering ring 341.

Thus, it will be seen that when the solenoid plunger is extended that the guide rods 346 move the centering ring 341 from the retracted position shown in FIG. 12 to the camming position of FIG. 13 in which the beveled cam edge 342 cams against the edge 333*a* of the container bottom wall if the container axis 330 is not aligned with the check's rotational axis 332. As seen in FIG. 13, the beveled edge 342 has cammed the edge 333*a* down and the centering ring is quickly retracted by the springs 352 before printing begins. While the centering ring is incomplete at the top, it nonetheless has sufficient accurate extent to engage and cam down the container if the rear edge of the container is too high. Manifestly, if the container is delivered with its axis aligned on the check's rotational axis, the centering ring 341 will not engage the container but will merely pass across the container's bottom end without contacting the same. If desired an additional set of guide rods parallel to the guide rods 346 maybe used to assure parallel and non-binding reciprocal movement of the centering ring. While the preferred centering means is in the form of a reciprocal ring it is to be understood that other forms of centering means may be used and fall within the purview of the appended claims.

Also, in accordance with this further embodiment of the invention of FIGS. 11–20, the takeoff and discharge transfer means 390 has been changed to eliminate the need for the take off fingers 136 and 137 to be shifted outwardly in the axial direction away from the chucks means 24 prior to the containers being shifted to the curing apparatus 40. As best seen in FIGS. 18 and 19, the take-off transfer means 390 comprises a pair of grippers fingers 401 and 402 similar to the gripper fingers 136 and 137 hereinbefore described. The gripper fingers 401 and 402 are pivoted between open and closed positions by a solenoid 404 mounted on the ends of the fingers. The fingers are pivotally mounted on a pivot point or shaft 405 which is horizontal and which extends through an upper end 406 of a bell crank 407. The bell crank is pivotally mounted at a fixed shaft 408 to a stationary frame member 409 (FIG. 20) which is a large, upstanding post. The bell crank is pivoted about the fixed shaft by an elongated drive or turn buckle 410 which is connected at its lower end to a crank arm 412 driven by a horizontal drive shaft 413 to pivot the bell crank to bring the fingers into position over the neck bottle or to a retracted position away from the neck of the bottle.

To deposit the container 20 on a conveyer, means are provided to pivot the take-off fingers 401 and 402 relative to the printing station and to swing the container 20 downwardly as the bell crank 407 is moving rearwardly away from the printing station. This pivoting mechanism includes a slidable slide bearing 420 which is mounted on an elongated slide shaft 422. The slide bearing is fixed at its center to the pivot shaft 405 to turn the shaft as the slide bearing moves along the slide shaft 422. The outer end of the slide shaft 442 is fixed to a crank bracket 425 which in turn is fixed at one end 426 to a horizontal shaft 427 mounted in a pair of upstanding bearings 429 and 430.

The bearings 429 and 430 are mounted in a bracket 432 mounted on the upper end of an inclined bar 434 which is fixed at a predetermined angle relative to the main frame post 409. The angle of inclination between the bar 434 and the post 409 may be adjusted and then secured at a fixed angle. The bar 434 is stationary and merely locates the shaft 427 at a given height and spacing from the gripping fingers 401 and 402.

The height of the bearings 429 and 430 and therefore the height of the shaft 427 is adjusted by sliding the inclined bar 434 relative to the bracket 432. A pair of elongated slots 440 formed in the elongated bar and bracket and threaded fasteners 448 extend through the slots and are tightened to grip the bar and bracket at the adjusted length.

The position of the sliding bearing 420 and the slide shaft 427 may be adjusted to accommodate different sizes of containers and locations of necks of the containers by sliding the shaft 427 axially in the bearings either toward or from the printing machine body. That is, the shaft 427 is slid along its axis toward or from the main frame of the machine with the shaft 427 sliding within the spaced bearings 429 and 430.

With mechanism described above in connection with FIGS. 18–20, the gripper fingers 401 and 402 merely pivot in a vertical plane and need not be shifted in an axial direction to remove the container 20 from the chucks means 24. The beveled edge 334 on the end face of the chuck merely cams against the rounded container beveled edge 333*a* and doesn't interfere with straight line removal of the container by the gripper fingers 401 and 402. Thus, the removal of the container may be accomplished more quickly than with the previously described take-off mechanism described in connection with FIGS. 1–10.

Also, in accordance with another embodiment of the invention illustrated in FIGS. 14–17, the container 20 is held in a holder or rest means 350 during the transfer operation at the transfer station 48 to the print transfer arm means 38 which has a nest 57 to receive and hold the preregistered container. It has sometimes occurred with the embodiment shown in FIGS. 1–10 that an out-of-round container 20 would not be held by suction at the time that the print transfer arm swung upwardly to the printing station 23 and, as a result, the container would be thrown off the nest. The holder means overcomes this problem by holding the container for a period of time sufficient that the suction grip is achieved before the container leaves the holder means.

The illustrated and preferred holding means 350 comprises resilient members or means 352 spaced apart to receive and hold the ends of the container with a releasible friction grip. More specifically, the second transfer arm means 38 will swing the container over the top of the holding means and push the container down between the upstanding resilient arms 354 and 356 which will be deflected by the bottom end wall 333 of the container 20 and the open small neck 357 of the container. Herein the resilient arms 354 and 356 have resilient pads thereon each having an outer plastic layer 360 covering an inner resilient compressible layer of rubber or plastic foam 361 which is compressed by the container which has a length longer than the distance between the plastic layers 360 on the respective arms. Thus, the suction may be broken in the second transfer arm means 38 and the suction cup 53 may be swung away after depositing the container in the holder means. A short time later, as shown in FIG. 16, the nest 57 will swing up from beneath and into the space between the holder arms to engage the underside of the preregister container and suction is applied through the ports 57*a* in the nest 57 from the vacuum hose 115 to grip the container for transfer to the printing station.

If the container 20 is non-circular at the suction port 57*a* in the nest 57, it is more difficult to establish the pressure differential to hold the container on the nest as some air leaks through and about any space between the container wall and the nest. Because the arms and the resilient pads thereon have an extended engagement with the ends of the container, the nest must force the container to slide across the resilient pads and against the resistance of the pads and during this resistance and during time it takes for the ends of container to leave the pads, the suction force from the suction port 57*a* becomes effective to hold the container irrespective if it is round or out-of-round. Thus, improved transfer is effected and the machine will continue to operate at high speeds even if some containers are out-of-round.

To adjust the grip by the pads on the container ends and to accommodate different sizes of containers, it is preferred that the resilient arm 354 and 356 be quickly and easily shifted toward or away from each other. As best seen in FIGS. 14 and 15, the arms are mounted in U-shaped brackets 370 and 371 and threaded adjustable fasteners 375 and 376 are threaded into upstanding flanges 378 on the brackets and extend to and are connected to the arms to move them toward or from their respective flanges 378.

In the embodiment illustrated in FIGS. 1–10, only a single suction cup 52 and 53 was associated with each transfer arm means 37 and 38 whereas in the embodiment illustrated in FIGS. 14–17, each of the transfer arm means 37 and 38 carries an additional suction cup 52*a* and 53*a* so that a pair of suction cups 52 and 52*a* lift the container from the conveyor and a second pair of suction cups 53 and 53*a* lift the preregistered container and swing it to the transfer station 48.

The suction cups 52*a* and 53*a* are mounted identically as hereinbefore described for the suction cups 52 and 53.

Rather using a sensing means 290 on the conveyor to sense if the container is properly positioned with its small end positioned outwardly to be engaged by the nose cone 26 (FIG. 7), in the embodiment of the invention disclosed in FIGS. 14–17, the suction cups 52*a* and 53*a* are located inwardly with the suction cups 52*a* and 53*a* located over an empty space above the container necks and hence the suction cups will continue to draw in air rather than establishing a pressure differential when the bottle neck is positioned beneath the inner suction cup 52*a* or 53*a*. More specifically, as best seen in FIGS. 15 and 17A. the inner suction cup 53*a* engages the right hand side of the container adjacent the container bottom wall when the container is properly originated. If the container is reversed in its orientation, as shown in FIGS. 17A, the suction cup 53 will be located over the neck 357 and air will flow into the suction cup as shown by the directional]arrow in FIG. 17A. A pressure sensitive switch senses the lack of the pressure differential due to grasping the container by a suction cup 52*a* or 53*a* and causes an alarm and stops the printing operation when either suction cup 52*a* or 53*a* does not grip a container wall during the transfer cycle.

From the foregoing it will be seen that new and improved apparatus in which the containers are moved by inexpensive oscillating transfer arms which are moved by continuing, turning cranks driven by a common chain means or drive. The speed of operation may be changed merely by changing the speed of rotation movement without any adjustments. Size adjustments for different sizes of containers can be readily made by moving the preregistered slide to change the radial distance of the preregister pin from the center line. The nest 57 can be shifted inwardly or outwardly by turning the threaded screw 118.

While a preferred embodiment has been shown and described, it will be understood that there is no intent to limit the invention by such disclosure but, rather, it is intended to cover all modifications and alternate constructions falling within the spirit and scope of the invention as defined in the appended claims.

What is claimed is:

1. In a screen printing apparatus for printing on articles rotated about a turning axis through the article, said apparatus comprising:

a screen printing means at a screen printing station including a screen holder for holding a printing screen, a squeegee means for forcing ink into through the screen at the printing station to print on rotatable article, means including a rotatable chuck means for rotating the article having a predetermined rotational axis of rotation at the printing station and beneath the printing screen, and a centering means for engaging and shifting an article to align the turning axis of the article with the rotational axis of said rotatable chuck means, said centering means comprising a non-rotatable ring movable in a direction parallel to the rotational axis, said chuck means and said article rotating within said non-rotatable ring, a non-rotatable actuator means to shift the non-rotatable ring by reciprocating the non-rotatable ring in the direction parallel to the rotational axis, and a camming surface on the ring to engage an end of an article not centered and to cam the article end to be centered on the rotational axis.

2. An apparatus in accordance with claim 1 in which said means to shift said ring includes parallel slide members connected to the ring to slide along slide surfaces, and a power operated cylinder means connected to the ring to shift it to slide said slide members along said slide surfaces.

3. An apparatus in accordance with claim 1 including automatic feed means for feeding the article to said chuck means and for holding the article as the centering means engages and shifts a misaligned article to bring its turning axis into alignment with the rotational axis of the chuck means.

4. An apparatus in accordance with claim 3 including discharge means to automatically feed the article from the chuck means and the printing station for discharge.

5. An apparatus in accordance with claim 4 in which said discharge means comprises grippers movable from a position spaced from the article into a gripping position at the printing station to grip the article while in the chuck means, and means to swing the grippers along an arcuate path to remove the article from the printing station.

6. In a screen printing apparatus for automatically handling and printing on objects having a turning axis, the combination comprising:

a frame, a screen printing station on said frame having a squeegee and screen assembly for screen printing on objects, rotatable means for rotating about a predetermined rotational axis to turn the objects about their turning axis while being printed upon at said screen printing station.

means for supplying a plurality of objects to a supply station for printing, a first oscillatory transfer means for picking up container at said supply station and for swinging the object through an arcuate path to a preregistering station, preregistering means at a preregistering station for rotating the object to a predetermined orientation, a second oscillatory transfer means for transferring a second object from the preregistering station by swinging the second object along an arcuate path to a transfer position, a third oscillatory means for receiving the second object at the transfer position and for swinging the second object through an arcuate path to said rotatable means at the printing station, centering means for centering the objects being delivered to said rotatable means to align the turning axis of the object with the rotational axis of the rotatable means, and discharge means for removing a third and printed object from the printing station and for depositing the printed object at a discharge station.

7. A screen printing apparatus in accordance with claim 6 in which said centering means comprises a cam ring to engage and cam an end of the object adjacent the chuck means.

8. In a screen printing apparatus for automatically handling printing on objects, the combination comprising:

a frame, a screen printing station on said frame having a squeegee and a screen assembly for screen printing on objects, means for supplying a plurality of objects at a supply station prior to printing, a first oscillatory transfer means for transferring an object from the supply station and for moving the object to a preregistering station, preregistering means at the preregistering station for rotating the object to a predetermined orientation, a second transfer means for transferring the preregistered object from the preregistering station to a holding station, holder means at the holding station for holding the preregistered object at said predetermined orientation, a third transfer means for removing the preregistered object from the holder means and for transferring the preregistered object from the holder means to the screen printing station, and discharge means for removing the printed object from the printing station and for depositing the printed object at a discharge station.

9. An apparatus in accordance with claim 8 in which said third transfer means includes an oscillatory transfer arm having a suction head thereon for gripping the object by means of suction to maintain the preregistered orientation of the object for delivery to the printing station.

10. An apparatus in accordance with claim 9 in which the holder means comprises a pair of holder members for gripping opposite ends of the container after release by the second transfer means and prior to gripping by the suction head of the third transfer means.

11. An apparatus in accordance with claim 10 in which said holder members comprise a pair of resilient, compressible pads spaced apart by a distance slightly less than the length of the object such that the object compresses the resilient, compressible pads and is frictionally held between the resilient, compressible pads until removed by the third transfer means.

12. An apparatus in accordance with claim 11 in which said holder members are adjustably mounted to accommodate different sizes of objects and to change the spacing therebetween to adjust the amount of compression of the resilient pads by the object.

13. An apparatus in accordance with claim 9 in which the suction head on the third transfer means comprises an arcuate nest for engaging the underside of the object and includes a suction port for applying a reduced pressure to an arcuate surface on the object being held in the nest.

14. An apparatus in accordance with claim 8 in which said holder means includes resilient members for engaging the opposite ends of the object and for resisting movement of the object by the third transfer means, said resilient members having sliding engagement with the ends of the container until the suction is established to hold the container on the arcuate nest.

15. An apparatus in accordance with claim 14 in which said resilient members comprise:

a pair of spaced compressible pads being engaged by and compressed by opposite ends of said object therebetween, said third transfer means comprising an oscillatory arm having an arcuate nest to engage an arcuate surface on the object, and suction means on said nest to establish a suction grip of the object while the ends of the object slide along said compressible pads.

* * * * *

UNITED STATES PATENT AND TRADEMARK OFFICE

CERTIFICATE OF CORRECTION

PATENT NO. : 4,862,798

DATED : September 5, 1989

INVENTOR(S) : PHIL MOTEV

It is certified that error appears in the above-identified patent and that said Letters Patent is hereby corrected as shown below:

Column 3, Line 30, after "the" insert --preregistration station;--.

Column 4, Line 9, after "assembly" insert a period.

Column 6, Line 68, change "s" to --is--.

Column 8, Line 66, after "mounted" delete comma.

Column 9, Line 37, after "container" insert a period.

Column 10, Line 57, change "switching" to --swinging--.

Column 12, Line 31, change "58" to --358--.

Column 15, Line 16, after "directional" delete bracket.

Column 16, Line 32, change period to comma.

Column 16, Line 35, after "up" insert --a--.

Signed and Sealed this

Fourth Day of September, 1990

*Attest:*

HARRY F. MANBECK, JR.

*Attesting Officer*

*Commissioner of Patents and Trademarks*